US007104841B2

(12) United States Patent
Fukatsu et al.

(10) Patent No.: US 7,104,841 B2
(45) Date of Patent: Sep. 12, 2006

(54) WATERTIGHT CONNECTOR

(75) Inventors: Yukihiro Fukatsu, Yokkaichi (JP); Kiyofumi Ichida, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/260,926

(22) Filed: Oct. 28, 2005

(65) Prior Publication Data

US 2006/0094275 A1 May 4, 2006

(30) Foreign Application Priority Data

Oct. 29, 2004 (JP) ..... 2004-316583

(51) Int. Cl.
*H01R 13/40* (2006.01)

(52) U.S. Cl. ..... 439/587; 439/275; 439/279; 439/723

(58) Field of Classification Search ..... 439/275, 439/587, 279, 721, 722, 724, 274, 588, 589
See application file for complete search history.

(56) References Cited

U.S. PATENT DOCUMENTS 6,174,201 B1 * 1/2001 Murakami et al. ..... 439/587
6,186,806 B1 2/2001 Suzuki et al.
6,193,549 B1 2/2001 Suzuki et al.
6,290,521 B1 9/2001 Suzuki et al.
6,309,252 B1 * 10/2001 Murakami et al. ..... 439/587
6,468,113 B1 * 10/2002 Murakami et al. ..... 439/752
6,527,586 B1 * 3/2003 Okamura et al. ..... 439/587
6,554,631 B1 * 4/2003 Ishikawa et al. ..... 439/274
6,558,179 B1 * 5/2003 Nakamura et al. ..... 439/275
6,638,108 B1 * 10/2003 Tachi ..... 439/595
6,692,301 B1 * 2/2004 Okayasu et al. ..... 439/587
6,752,644 B1 * 6/2004 Shibata ..... 439/271
6,752,659 B1 * 6/2004 Nakamura et al. ..... 439/587
6,872,092 B1 * 3/2005 Oka ..... 439/587
6,913,486 B1 * 7/2005 Nagayasu et al. ..... 439/587
2002/0002000 A1 * 1/2002 Okamura et al. ..... 439/587
2002/0115345 A1 * 8/2002 Nakamura et al. ..... 439/587
2002/0119690 A1 * 8/2002 Nakamura et al. ..... 439/275
2002/0177359 A1 * 11/2002 Fukatsu et al. ..... 439/587
2003/0087551 A1 * 5/2003 Okayasu et al. ..... 439/587
2004/0029442 A1 * 2/2004 Oka ..... 439/587
2004/0092163 A1 * 5/2004 Nagayasu et al. ..... 439/587
2005/0106916 A1 * 5/2005 Nomura ..... 439/275
2005/0118850 A1 * 6/2005 Ito ..... 439/275
2005/0245130 A1 * 11/2005 Shiga et al. ..... 439/587
2006/0040553 A1 * 2/2006 Yamashita ..... 439/589

* cited by examiner

*Primary Examiner*—Ross Gushi
(74) *Attorney, Agent, or Firm*—Gerald E. Hespos; Anthony J. Casella

(57) ABSTRACT

A watertight connector has a housing (10) with terminal fittings (11) therein. A busbar element (14) is mounted on the front of the housing (10) to short the terminal fittings (11). The busbar element (14) engages engageable portions (22; 23) formed by a mold removing space (24) in the housing (10). A rubber plug (12) and a plug holder (13) are assembled with the housing (10) by engaging locks (25) on the plug holder (13) with the housing (10). The locks (25) are inserted into the mold removing spaces (24). The locks (25) and the engageable portions (22, 23) overlap in width and/or height directions to miniaturize the watertight connector.

16 Claims, 22 Drawing Sheets

WATERTIGHT CONNECTOR

BACKGROUND OF THE INVENTION

1. Field of the Invention

The present invention relates to a watertight connector.

2. Descriptiong of the Related Art

U.S. Pat. No. 6,186,806, U.S. Pat. No. 6,193,549, U.S. Pat. No. 6,290,521 and FIGS. 20–22 herein all disclose watertight connectors. With reference to FIGS. 20–22, the watertight connector has cavities 100 formed in a synthetic resin housing 101. A busbar 102 is formed as part of a busbar element 103 that is mounted at the front end (right side in FIG. 20) of the housing 101. The busbar 102 is fit into the respective cavities 100 to short the terminal fittings in a specified pattern. The terminal fittings are passed through sealing holes 104 of a sealing member 105 provided at the rear end (left side in FIG. 20) of the housing 101 for individually sealing wires connected with the terminal fittings. A seal holder 106 is provided behind the sealing member 105 for tightly holding the sealing member 105 in cooperation with the housing 101.

The busbar element 103 includes a holder 107 and the busbar 102 is disposed in the holding element 107. The holder 107 has a rearwardly projecting tube 108, and guide grooves 109 extend forward and back at each of the left and right ends of the tube 108. On the other hand, the housing 101 is formed with locking projections 110 corresponding to the guide grooves 109. The busbar element 103 is held onto the housing 101 by the engagement of the guide grooves 109 with the locking projections 110.

Two holding projections 111 project back from the opposite left and right ends of the rear end surface of the housing 101, as shown in FIG. 21, and a locking piece 111A is formed at the leading end of each holding projection 111. Fitting holes penetrate the sealing member 105 in forward and backward directions and receive the holding projections 111 of the housing 101. As shown in FIG. 22, the seal holder 106 has retaining holes 112 that align with the holding projections 111, and a stepped receiving portion 113 is formed on the inner wall of each retaining hole 112. The sealing member 105 is assembled with the housing 101 while engaging the fitting holes thereof with the holding projections 111, and the seal holder 106 is assembled with the housing 101 by engaging the locking pieces 111A of the holding projections 111 with the receiving portions 113 of the retaining holes 112 to hold the sealing member 105 in cooperation with the housing 101. Thus the sealing member 105 and the sealing-member holder 106 are held on the housing 101.

The locking projections 110 are formed by rearwardly removing a mold. Thus, the housing 101 needs mold removing spaces 114 that extend from the rear ends of the locking projections 110 to the rear end of the housing 101. The holding projections 111 on the rear end of the housing 101 are formed at positions displaced from the locking projections 110 in the height direction or width direction to avoid the mold removing spaces 114 (see FIG. 21). As a result, the watertight connector has been difficult to miniaturize.

The present invention was developed in view of the above problem and an object thereof is to miniaturize a watertight connector.

SUMMARY OF THE INVENTION

The invention relates to a watertight connector with a housing that has at least one cavity for accommodating at least one terminal fitting. A mounting member is mountable on the housing. A resilient plug also is arranged on the housing and is formed with at least one sealing hole through which the respective terminal fitting is inserted to seal wires connected with the respective terminal fittings. A plug holder engages the housing to hold the resilient plug between the plug holder and the housing. The housing has a main portion and at least one bulge that bulges out in width and/or height directions from the main portion. The bulge has at least one engageable portion that engages a latch of the mounting member for holding the mounting member. A mold removing space is formed by removing a mold for forming the engageable portion and extends from an end of the engageable portion to an end surface of the bulge. A receiving portion is adapted to hold the plug holder by engaging a lock on the plug holder. The lock is arranged for insertion into the mold removing space and to overlap the engageable portion in at least one of width and height directions. Thus, the housing can be miniaturized along the direction in which the lock and the engageable portion overlap.

The mounting member preferably is at the front of the housing.

The resilient plug preferably is at the rear end of the housing.

The receiving portion preferably is at a position displaced out from the mold removing space substantially in the width and/or height direction.

The lock preferably penetrates the plug in the thickness direction.

The plug holder and the resilient plug initially can be positioned with each other by letting the lock penetrate the plug in the thickness direction. The plug holder and the housing then are assembled by engaging the lock and the receiving portion of the housing while holding the plug between the plug holder and the housing. Thus, the plug holder and the plug can be positioned with each other and the plug and the housing can be positioned with each other.

A part of the lock that penetrates the resilient plug in the thickness direction preferably has a substantially elliptic cross section whose minor axis extends substantially along the width direction or the height direction. Thus, the connector can be miniaturized along the width or height direction.

A busbar preferably is provided in the mounting member and fits into the respective cavities for shorting the terminal fittings.

A bottomed cap preferably is mounted on the housing to cover the mounting member and the housing from a fitting side of the mounting member when the mounting member is mounted on the housing.

A sealing edge preferably is formed on the outer peripheral edge of the resilient plug for closely contacting the inner peripheral surface of the cap to provide sealing between the housing and the cap.

The engageable portion and the lock preferably overlap in both width and height directions.

These and other features and advantages of the invention will be more apparent after reading the following description of preferred embodiments and accompanying drawings. Even though embodiments are described separately, single features may be combined to additional embodiments.

DETAILED DESCRIPTION OF THE RELATED ART

A watertight connector according to the invention is illustrated in FIGS. 1 to 16. In the following description, a connecting side with a mating connector and a substantially opposite side (right and left sides in FIG. 1) are referred to respectively as the front and rear sides, and reference is made to FIG. 2 concerning the vertical direction.

Figure 4:
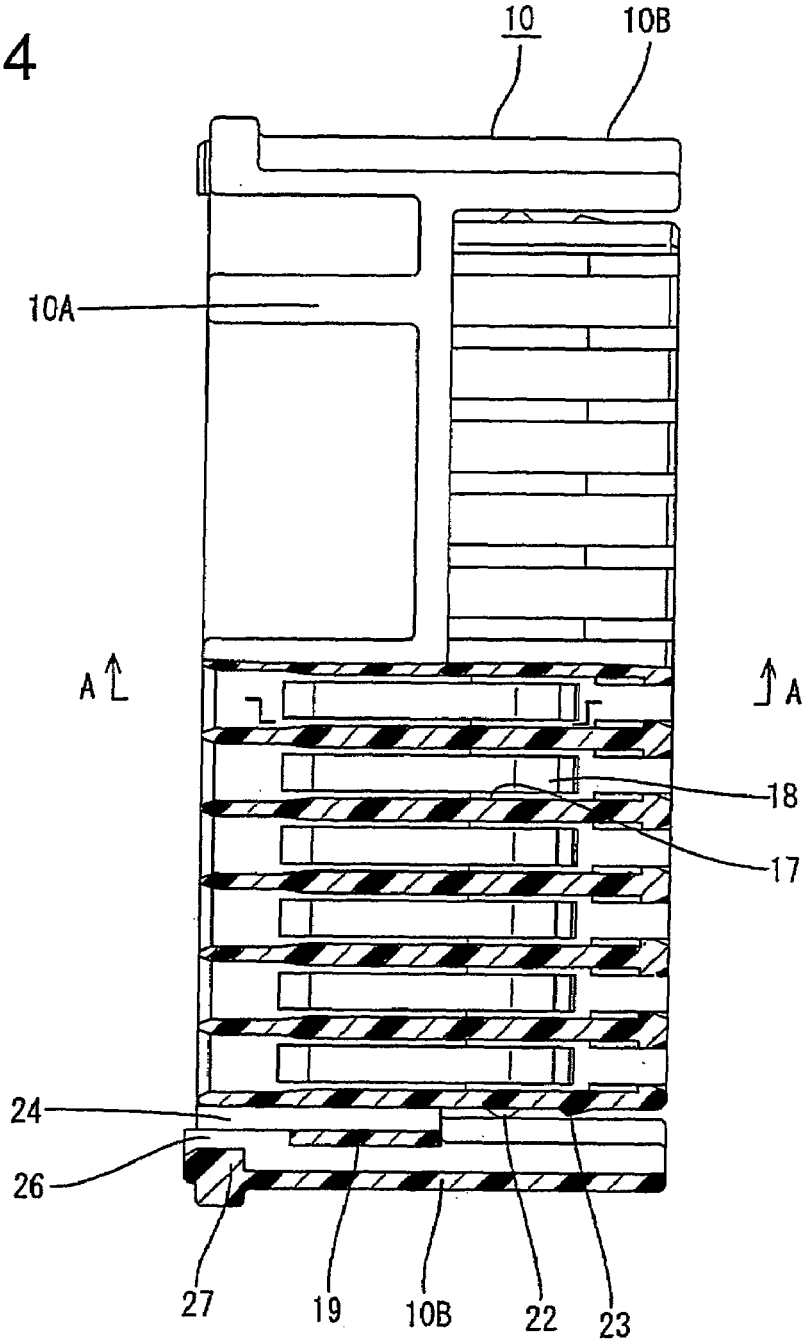
FIG. 4 is a plan view partly in section of a housing.
Figure 5:
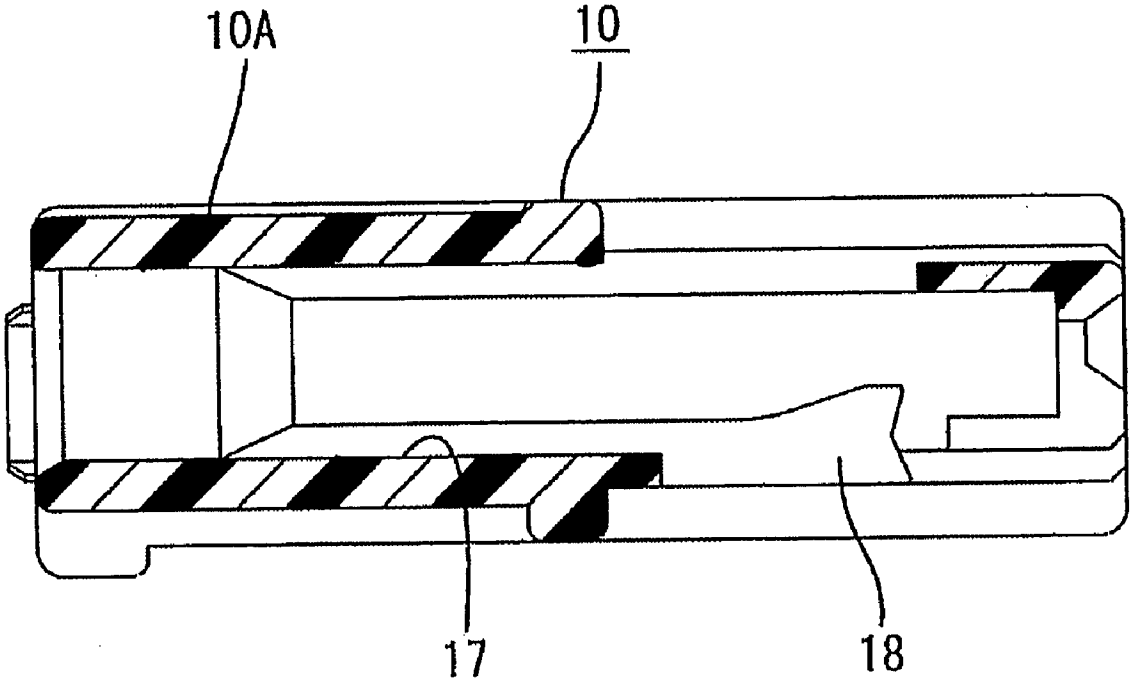
FIG. 5 is a section along 5—5 of FIG. 4.

The connector includes a housing 10 made e.g. of a synthetic resin. The housing 10 has a main portion 10A and bulges 10B bulge out substantially in a width direction WD from the left and right surfaces of the main portion 10A as shown in FIG. 4. Cavities 17 are formed substantially side by side in stages at specified intervals in the main portion 10A. The cavities 17 extend substantially in forward and backward directions FBD and substantially normal to the width direction WD. As shown in FIG. 5, a front portion of each cavity 17 is exposed at the bottom surface of the main portion 10A, and a lock 18 is cantilevered substantially forward in the open area.

As shown in FIG. 4, the bulges 10B are distanced from the main portion 10A. Two engageable portions 22, 23 project out from the outer surface of each of the left and right walls of the main portion 10A while being displaced substantially along forward and backward directions FBD and along a vertical direction VD that is substantially normal to both the forward and backward directions FBD and the width direction WD. The engageable portions 22, 23 are formed by rearwardly removing a mold (not shown) for forming the engageable portions 22, 23. Thus, each bulge 10B has a mold removing space 24 extending from the rear ends of the engageable portions 22, 23 to the rear edge of the bulge 10B and located at the inner side of a partition wall 19.

Figure 6:
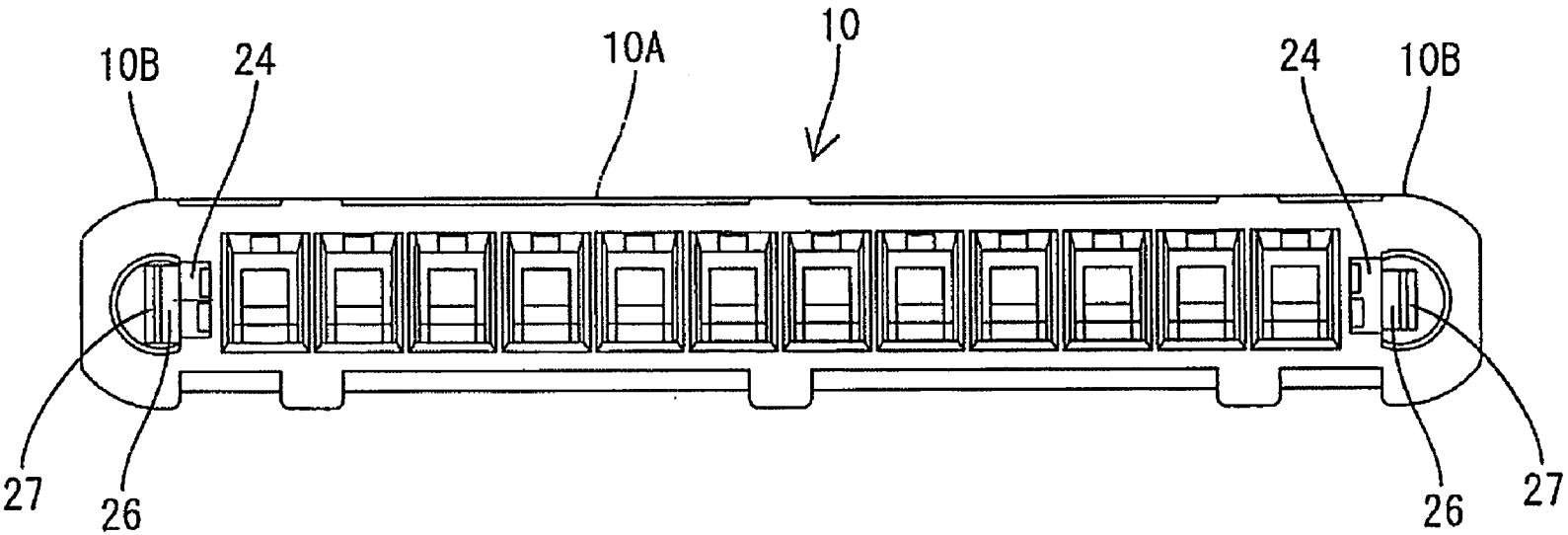
FIG. 6 is a rear view of the housing.

Further, as shown in FIG. 6, a retaining hole 26 is formed in the rear end surface of each bulge 10B at an outer widthwise side of the mold removing space 24, and a widthwise inner side of each retaining hole 26 communicates with the corresponding mold removing space 24. A stepped receiving portion 27 is formed at a part of the inner surface of each retaining hole 26 located at the widthwise outer side by engaging a locking piece 25A of the corresponding lock 25 for preventing the detachment of the rubber-plug holder 13 from the housing 10. The height of the right retaining hole 26 in FIG. 6 is less than the height of the left retaining hole 26. Thus, the housing 10 is transversely asymmetric with respect to a direction substantially normal to the width direction WD.

Figure 2:
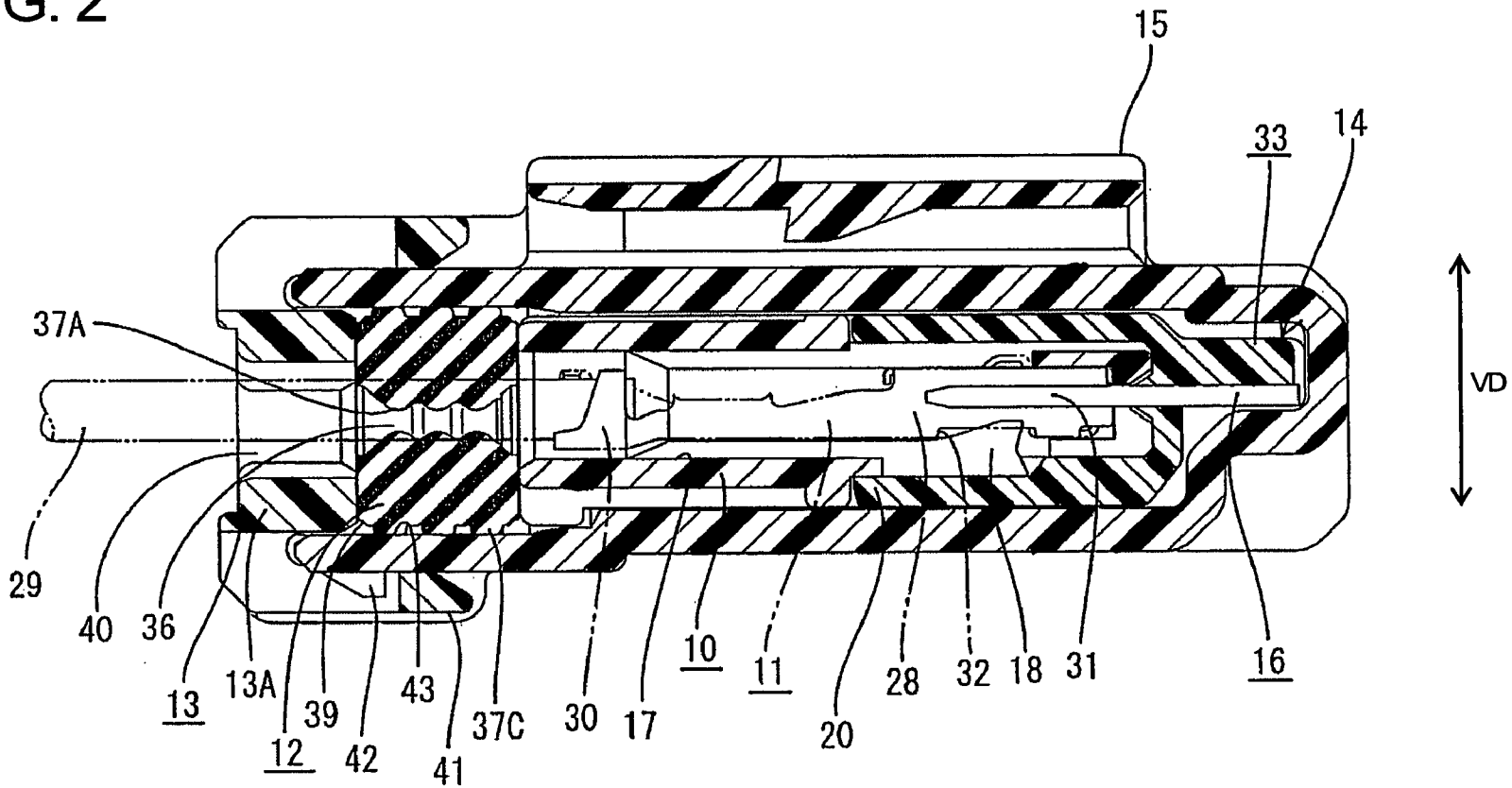
FIG. 2 is a section showing the assembled state.
Figure 3:
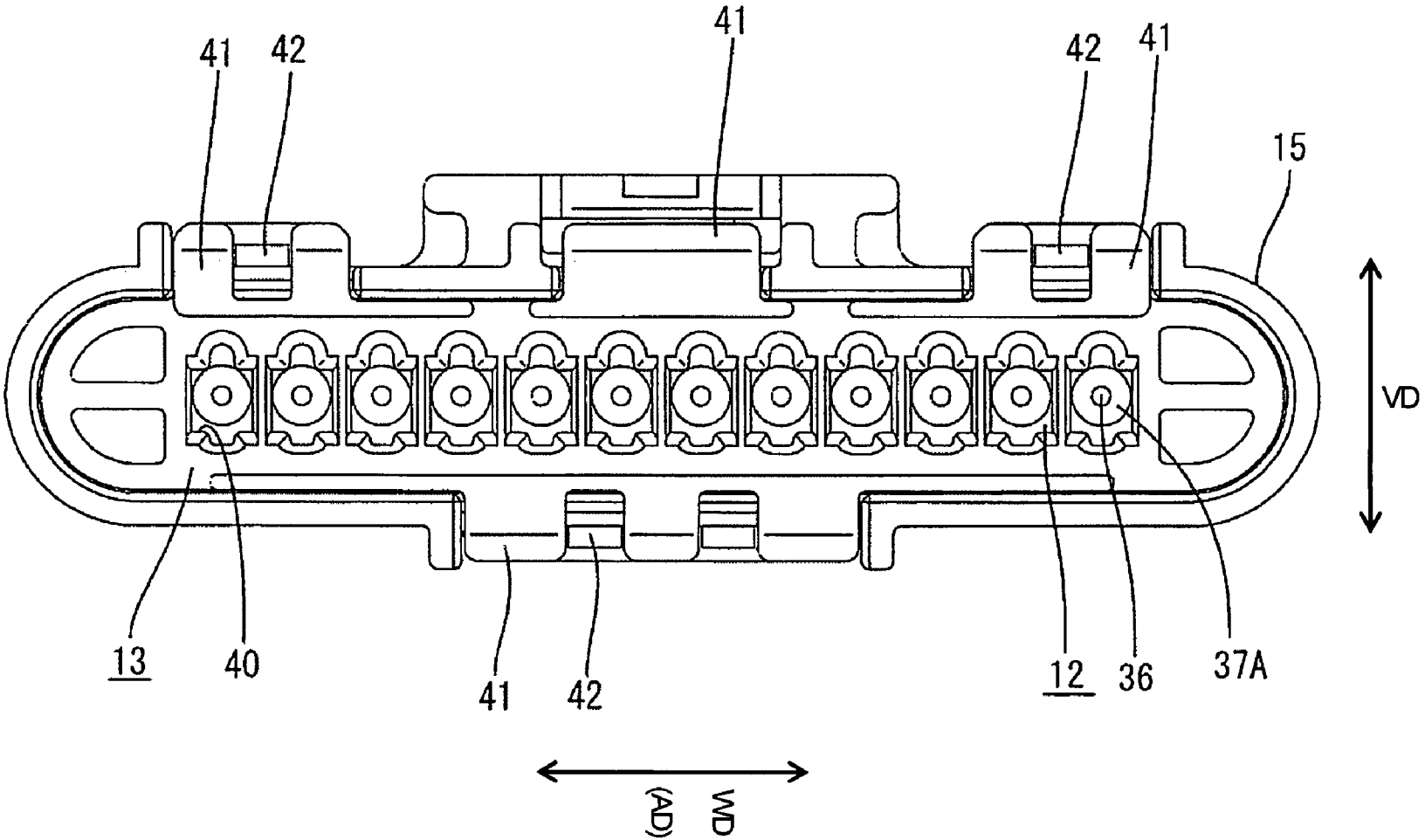
FIG. 3 is a rear view showing the assembled state.

Each female terminal fitting 11 is formed by bending, folding and/or embossing a metal plate that has been stamped or cut into a specified shape. A rectangular tubular fitting 28 is formed at the front of each female terminal fitting 11 and is hollow in forward and backward directions FBD. A wire connecting portion 30 is formed at the rear of each female terminal fitting 11 and is configured for crimped, bent or folded connection with a wire 29, as shown in FIG. 2. A resilient contact piece (not shown) is formed in the fitting 28 and is configured to resiliently contact a connecting piece 31 of the busbar element 14. A locking hole 32 is formed in a surrounding wall of the tubular fitting 28 and engages a lock 18 of the housing 10. The female terminal fitting 11 is inserted from behind into the cavity 17 of the housing 10 that has the one-piece rubber plug 12 and the rubber-plug holder 13 mounted therein. Thus, the female terminal fitting 11 penetrates the rubber plug 12 and the plug holder 13. The lock 18 interferes with the outer surface of the surrounding wall of the tubular fitting 28 immediately before the female terminal fitting 11 reaches a proper insertion position. Thus, the lock 18 resiliently deforms away from the terminal 11 to project outward of the housing 10. When the female terminal fitting 11 reaches the proper insertion position, the lock 18 is restored resiliently and engages the locking hole 32 to retain the female terminal fitting 11.

Figure 7:
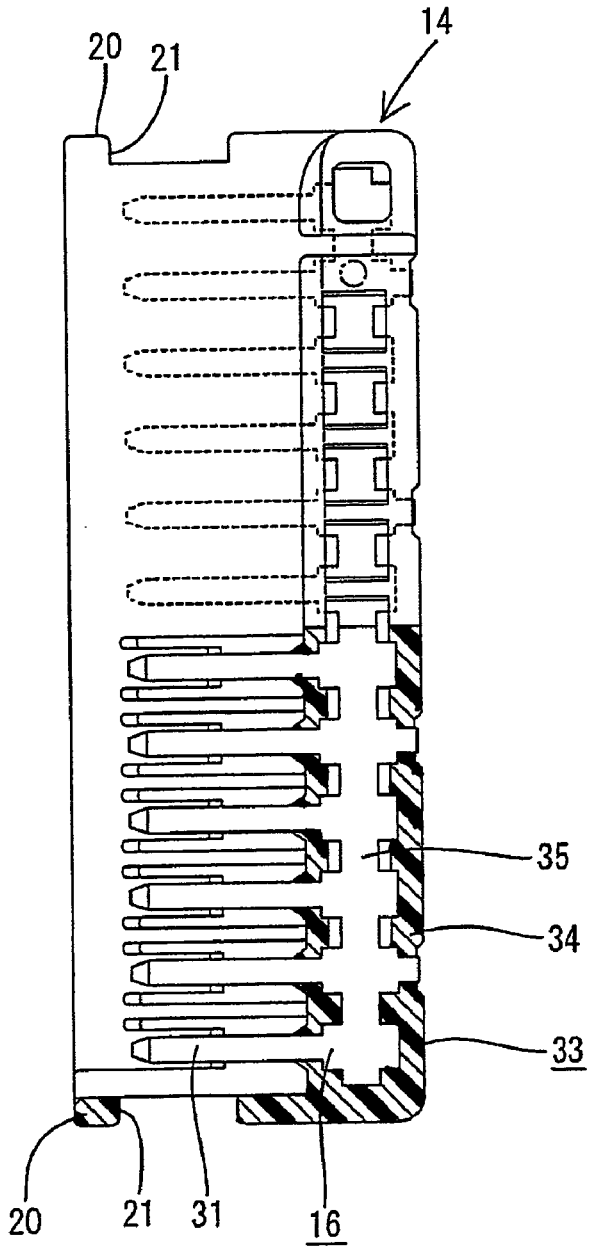
FIG. 7 is a plan view partly in section showing a busbar element.

As shown in FIG. 7, the busbar element 14 is an integral insert molded assembly of a synthetic resin holding element 33 and a conductive preferably metal busbar 16. The holding element 33 has a wide plate-shaped holding portion 34 and a substantially flat tube 20 projects back towards the housing 10 from the plate-shaped holding portion 34. The busbar 16 is formed so that substantially parallel connecting pieces 31 are cantilevered from a lateral edge of a substantially strip-shaped coupling 35. The busbar 16 is held so that the coupling 35 extends substantially along the plate-shaped holding portion 34 and the connecting pieces 31 are in the tube 20. Further, guide grooves 21 penetrate the tube 20 at the left and/or right ends and extend substantially in forward and backward directions FBD.

Figure 1:
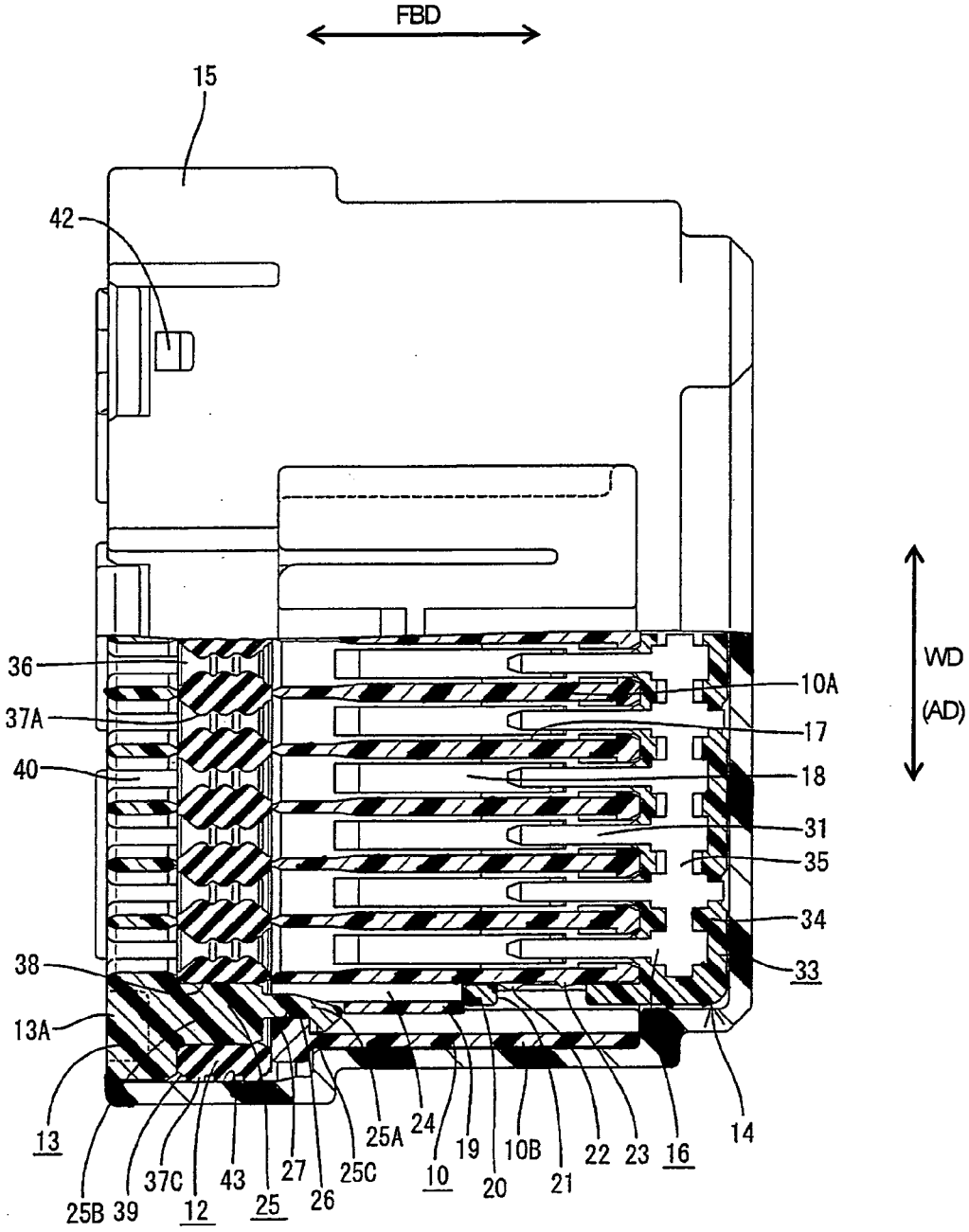
FIG. 1 is a plan view partly in section showing an assembled state of a watertight connector according to a first embodiment.

The busbar element 14 is assembled to cover the main portion 10A by the tube 20 and can be held at a partial locking position and a full locking position on the housing 10. Although not shown, the front ends of the engageable portions 22 engage the rear end of the tube 20 from behind and the rear ends of the engageable portions 23 engage the rear edges of the guide grooves 21 from behind at the partial locking position. Thus, the busbar element 14 is prevented from being displaced in forward and backward directions FBD. The connecting pieces 31 at the partial locking position do not to touch the female terminal fittings 11, and hence avoid creating a connection resistance during insertion of the female terminal fittings 11. At the full locking position, both engageable portions 22, 23 are fit in each guide groove 21 as shown in FIG. 1. Thus, the front end of the engageable portion 22 engages the rear edge of the guide groove 21 from the front and the rear end of the engageable portion 23 engages the front edge of the guide groove 21 from behind to prevent the busbar element 14 from being displaced in forward and backward directions FBD. As shown in FIG. 2, the respective connecting pieces 31 connect with and short a plurality of female terminal fittings 11 when the busbar element 14 is at the full locking position.

The rear end of the tube 20 is more forward than the leading ends of the locks 18 when the busbar element 14 is held at the partial locking position on the housing 10.

Figure 8:
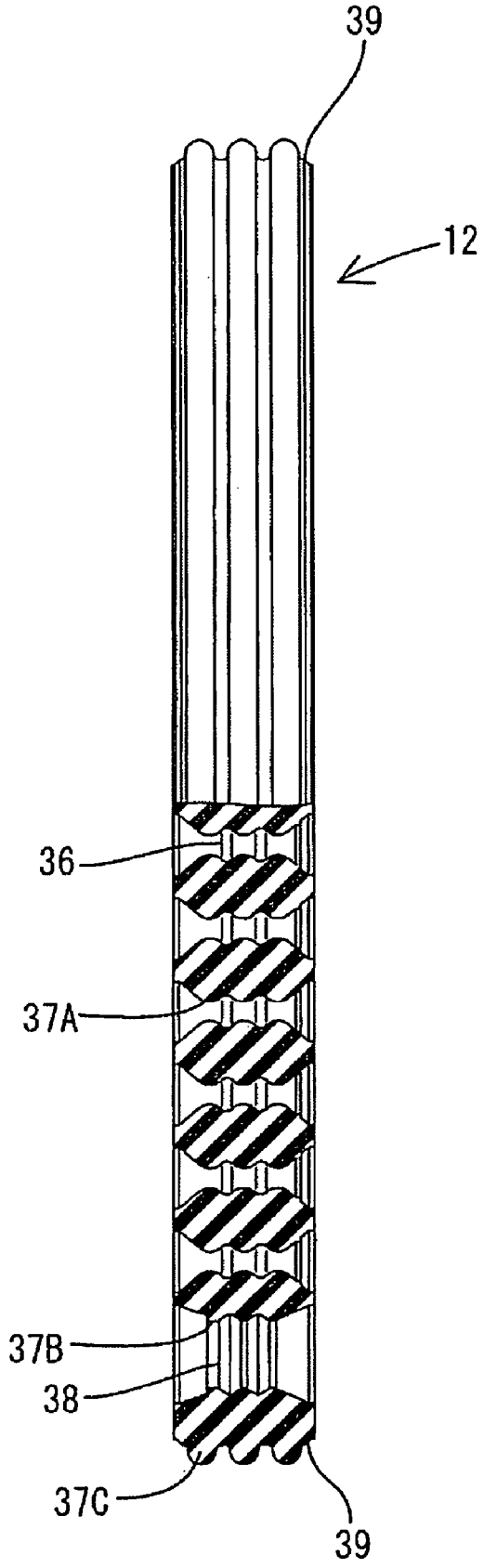
FIG. 8 is a plan view partly in section of a one-piece rubber plug.
Figure 9:
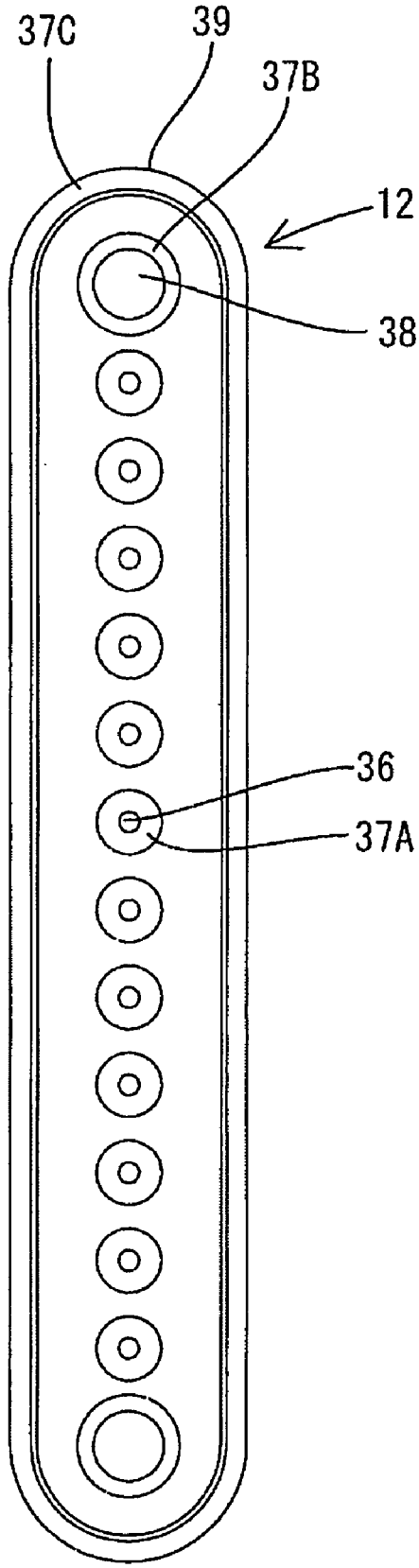
FIG. 9 is a rear view of the one-piece rubber plug.

The rubber plug 12 is molded unitarily of resilient resin, and preferably a substantially natural or synthetic rubber. More particularly, the rubber plug 12 is a substantially oblong thick plate, as shown in FIGS. 8 and 9, and is held between the rear end surface of the housing 10 and the front end surface of the plug holder 13. Sealing holes 36 penetrate the rubber plug 12 in forward and backward directions FBD and substantially align with the respective cavities 17 of the housing 10. Each sealing hole 36 is substantially round. However, lips 37A of pointed or triangular cross section are formed circumferentially on the inner circumferential surface of the sealing hole 36. The inner diameter of the lips 37A enables insertion of the female terminal fittings 11 and is smaller than the outer diameter of the wires 29. Thus, the lips 37A achieve close resilient contact with the outer circumferential surface of the wire 29 to provide sealing between the wire 29 and the sealing hole 36 when the female terminal fitting 11 is inserted properly. The resilient plug may be alternatively made of gelatinous material.

Fitting holes 38 penetrate the rubber plug 12 in forward and backward directions FBD and receive the locks 25 of the rubber-plug holder 13. Each fitting hole 38 is substantially round and three lips 37B of pointed or triangular cross section are formed circumferentially on the inner circumferential surface of the fitting hole 38. The inner diameter of the lips 37B is slightly smaller than the outer diameter of base portions 25B of the locks 25 to achieve sealing is given between the fitting holes 38 and the locks 25.

A sealing edge 39 is formed on the outer peripheral surface of the rubber plug 12 and includes three peripheral lips 37C. The lips 37C resiliently contact the inner peripheral surface of the cap 15 to provide sealing between the rubber plug 12 and the cap 15. The outer periphery of the rubber plug 12 is slightly larger than that of the rear end of the housing 10. Thus, the rubber plug 12 bulges out from the outer periphery of the rear end of the housing 10 with respect to the width direction WD and the vertical direction VD.

Figure 10:
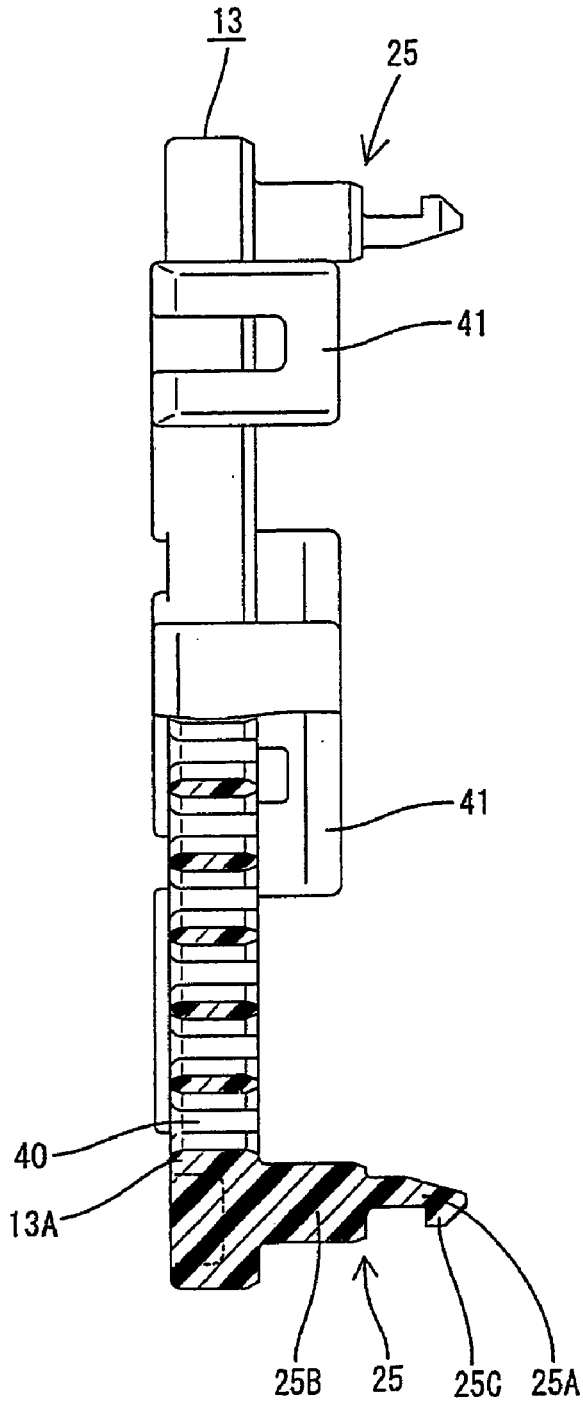
FIG. 10 is a plan view partly in section of a rubber-plug holder.
Figure 11:
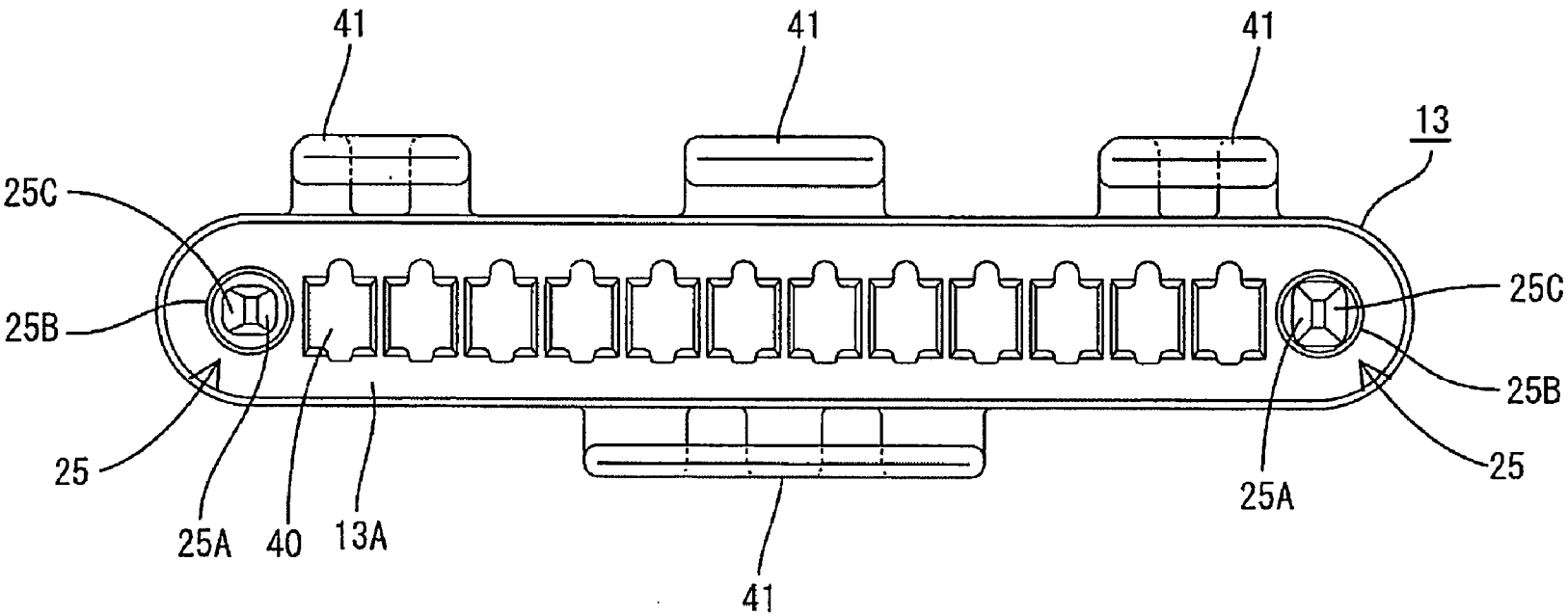
FIG. 11 is a front view of the rubber-plug holder.
Figure 12:
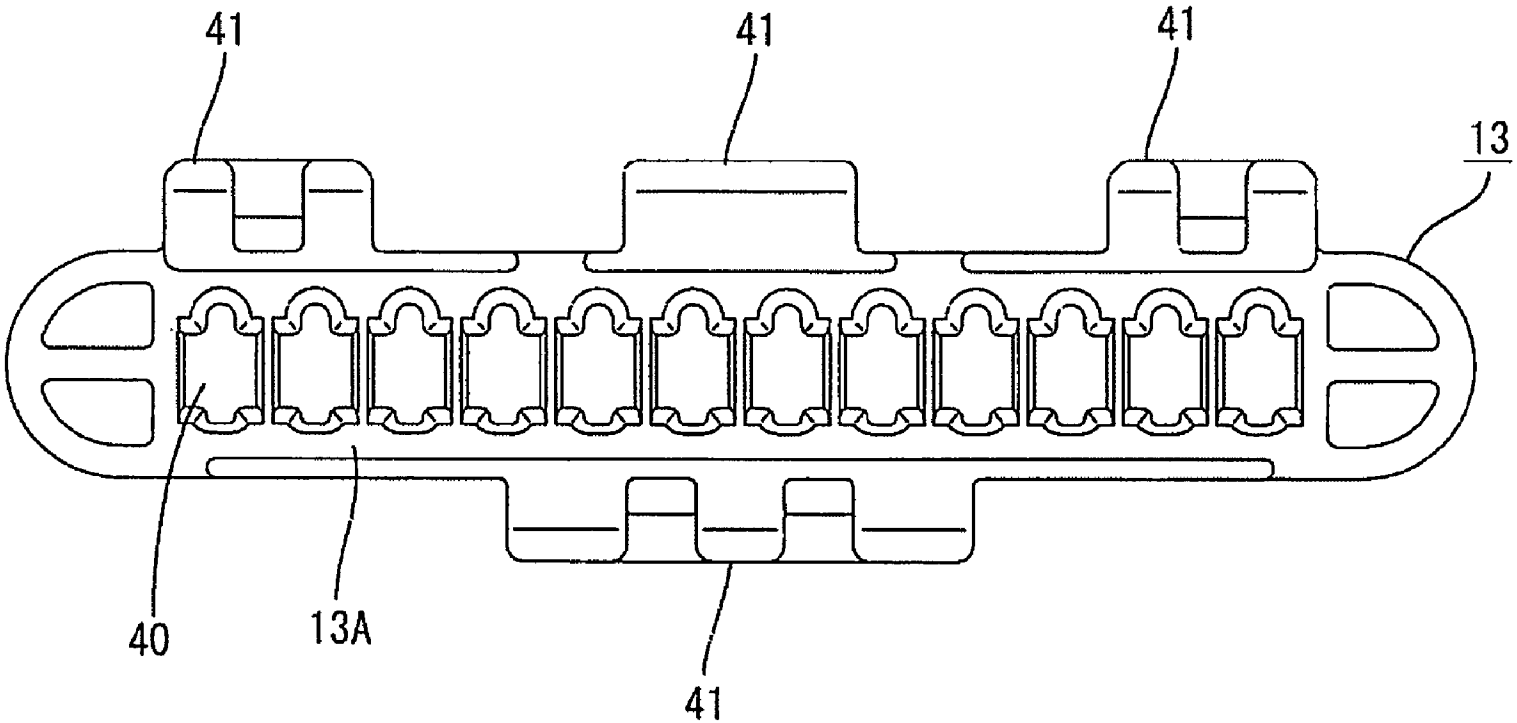
FIG. 12 is a rear view of the rubber-plug holder.
Figure 13:
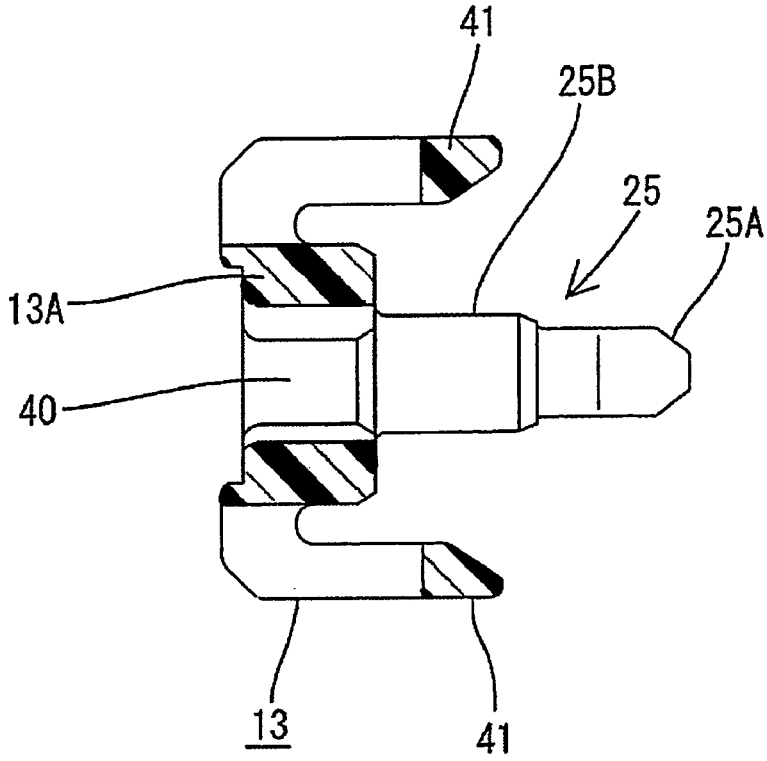
FIG. 13 is a section of the rubber-plug holder.

The plug holder 13 is made e.g. of a synthetic resin and includes a thick oblong main body 13A with a plate-shape similar to the rubber plug 12, as shown in FIGS. 10 and 11. The outer periphery of the main body 13A is slightly smaller than the outer periphery defined by the lips 37C of the rubber plug 12. Terminal insertion holes 40 penetrate the main body 13A in forward and backward directions FBD and align with the respective cavities 17 and the sealing holes 36. Thus, the female terminal fittings 11 can be inserted through the terminal insertion holes 40 and into the cavities 17. As shown in FIGS. 11 and 12, each terminal insertion hole 40 has a substantially rectangular cross section with a rounded contour on the upper side. Thus, the terminal insertion hole 40 is asymmetric with respect to the width direction W so that the female terminal fittings 11 cannot be inserted upside-down As shown in FIGS. 10 and 13, lock pieces 41 extend forward of the holder main body 13A to prevent the cap 15 from coming off.

Locks 25 project forward at the left and right sides of the front surface of the main body 13A, as shown in FIGS. 10 and 11. A substantially rectangular locking piece 25A is formed at the front of each lock 25 and a substantially cylindrical base 25B is formed at the rear of the lock 25. The base 25B is cross-sectionally larger than the locking piece 25A. A locking projection 25C projects laterally out from a leading end of the locking piece 25A and is engageable with the receiving portion 27 of the corresponding bulge 10B to prevent the plug holder 13 from being withdrawn backward.

The locking piece 25A at the right side of FIG. 11 projects farther than the locking piece 25A at the left side of FIG. 11. Thus, the plug holder 13 is transversely asymmetric. The retaining holes 26 of the housing 10 also are transversely asymmetric, as described above. Thus, the plug holder 13 cannot be assembled to the housing 10 upside down. As a result, the abnormal connection of the plug holder 13 and the housing 10 can be determined before the female terminal fittings 11 and the wires 29 are inserted through the sealing holes 36 of the rubber plug 12.

The locking pieces 25A enter the mold removing spaces 24 and the adjacent retaining holes 26 as the plug holder 13 is assembled to the housing 10. The locking pieces 25A then move onto the receiving portions 27 and deform resiliently inwardly along the width direction WD into the mold removing spaces 24. Thus, the resiliently deformed locking pieces 25A overlap the engageable portions 22, 23 in the mold removing direction (i.e. the width direction WD and/or vertical direction VD).

The locking projections 25C engage the receiving portions 27 from the front when the plug holder 13 and the housing 10 are assembled properly to prevent the plug holder 13 from coming off backward. As described above, the mold removing spaces 24 accommodate deformation of the locking pieces 25A, and hence the locking pieces 25A can deform more. Accordingly, larger areas of engagement can be achieved between the locking pieces 25A and the receiving portions 27, and a force for holding the plug holder 13 and the housing 10 together can be increased.

Figure 14:
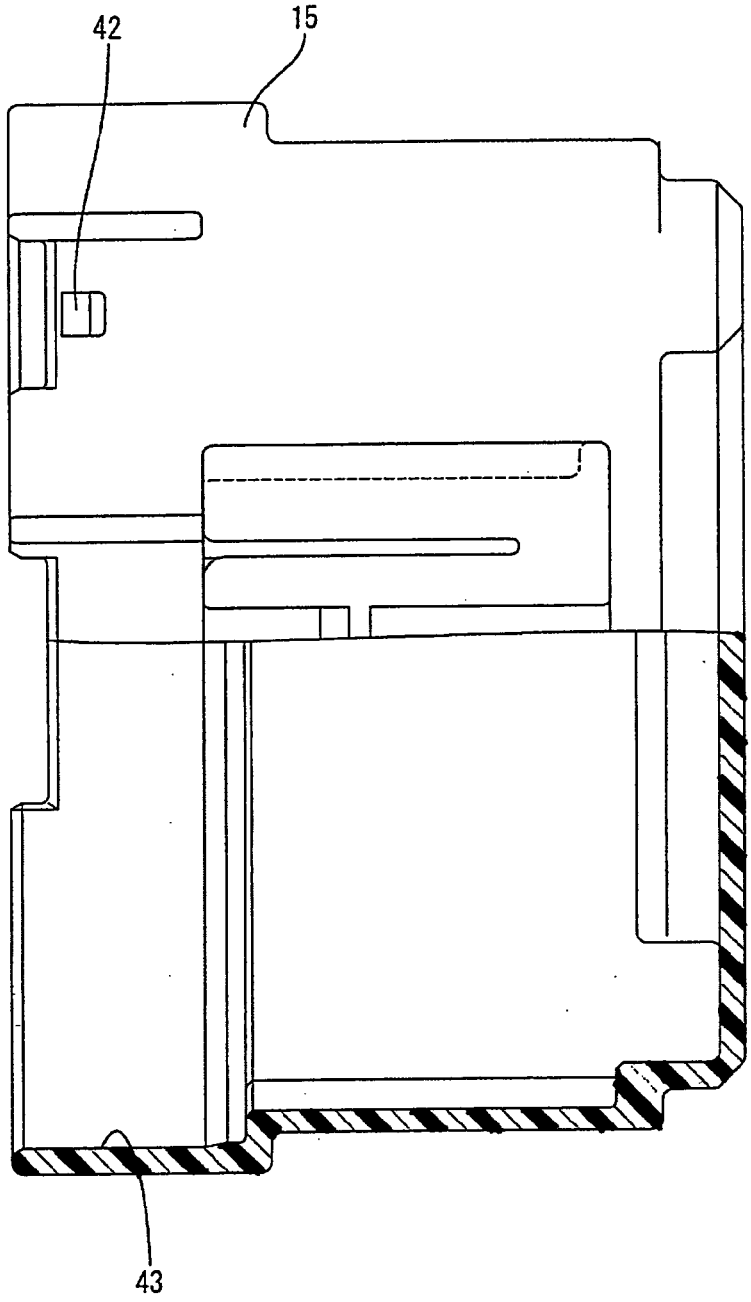
FIG. 14 is a plan view partly in section of a cap.
Figure 15:
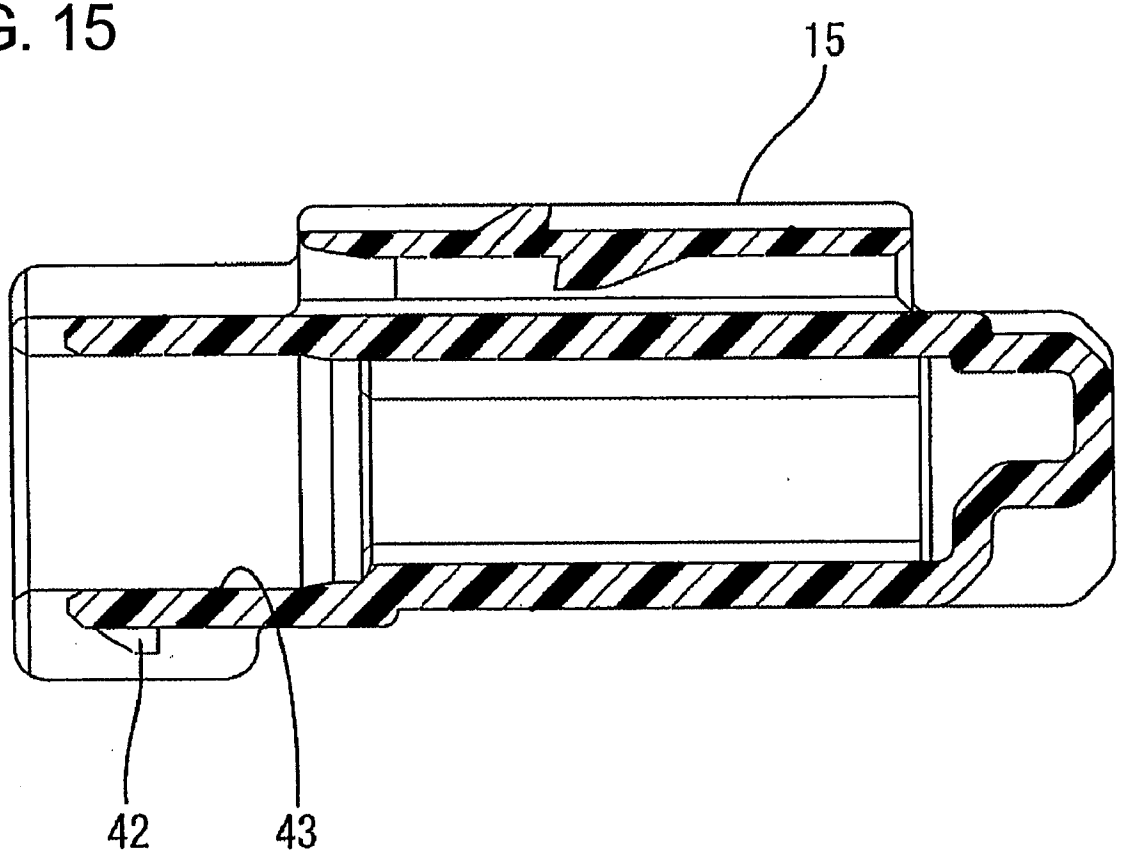
FIG. 15 is a section of the cap.
Figure 16:
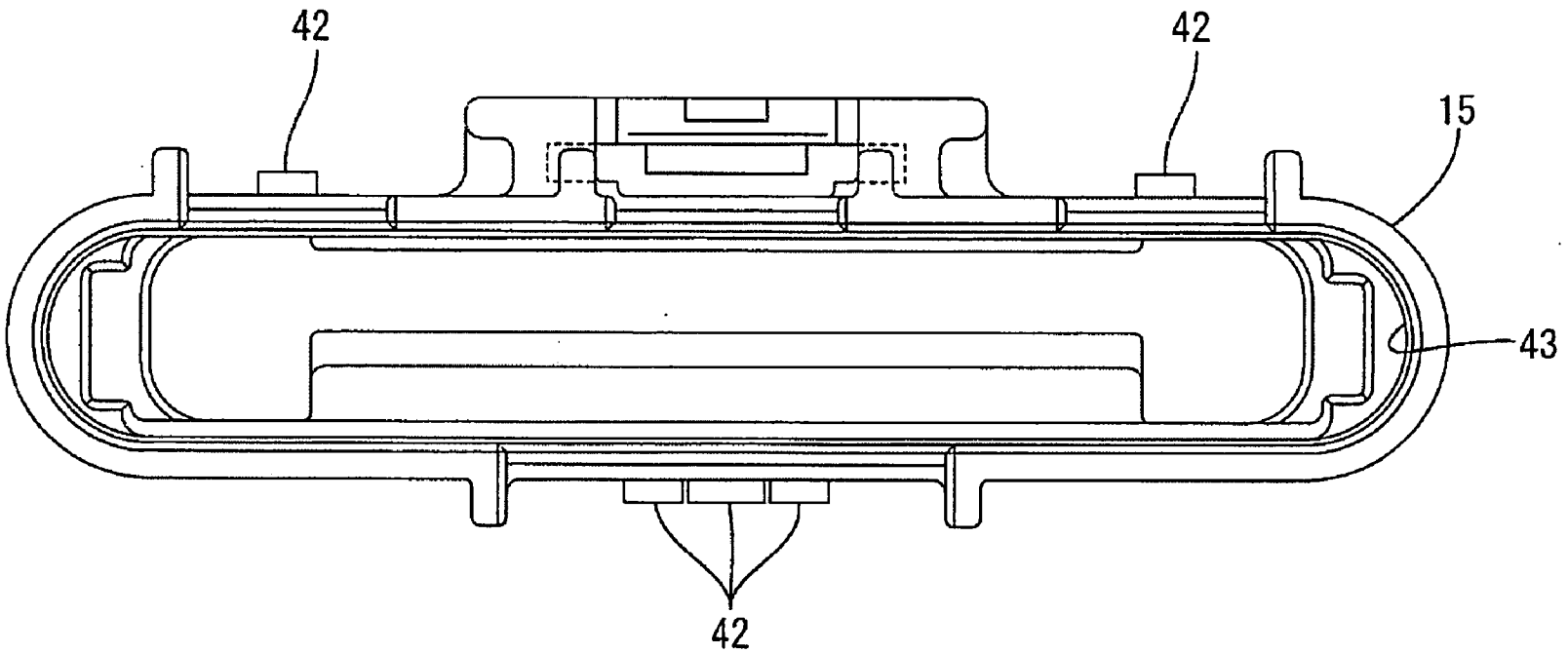
FIG. 16 is a rear view of the cap.

The cap 15 is made e.g. of a synthetic resin and defines a bottomed tube of substantially oblong plan view, as shown in FIGS. 14 to 16. Lock projections 42 are formed at the opening edge of the cap 15 and in positions corresponding to the lock pieces 41. Thus, the lock pieces 41 can engage the lock projections 42 to lock the cap 15 in its assembled state (see FIG. 3). Further, a sealing surface 43 is defined in an area of the inner circumferential surface of the cap 15 near the opening edge for resilient contact with the lips 37C on the outer peripheral surface of the rubber plug 12.

The connector is assembled by introducing the locks 25 through the fitting holes 38 for positioning the plug holder 13 and the rubber plug 12 with each other. The locking pieces 25A of the locks 25 then engage the receiving portions 27 of the retaining holes 26 to hold the rubber plug 12 between the plug holder 13 and the housing 10 for assembling the plug holder 13 with the rear end of the housing 10. In this way, the housing 10 and the rubber plug 12 are positioned with each other. The busbar element 14 is mounted at the partial locking position at the front end of the housing 10. Subsequently, the female terminal fittings 11 are inserted through the respective terminal insertion holes 40 and the respective sealing holes 36 and into the respective cavities 17. Thereafter, the busbar element 14 is moved from the partial locking position to the full locking position to short the female terminal fittings 11 in a specified pattern. The lock 18 projects out if any female terminal fitting 11 is inserted insufficiently and the outwardly projecting lock 18 restricts movement of the busbar element 14. Thus, the insufficient insertion of the female terminal fitting 11 can be detected. The cap 15 then is mounted on the housing 10 and the busbar element 14. The lips 37C on the outer peripheral surface of the rubber plug 12 prevent the entry of water into the cap 15 through a clearance between the inner peripheral surface of the cap 15 and the outer peripheral surface of the rubber plug 12. Further, the lips 27A of the sealing holes 36 closely contact the outer circumferential surfaces of the wires 29 and the lips 37B of the fitting holes 38 closely contact the outer circumferential surfaces of the locks 25 to prevent entry of water from the outer surface of the rubber plug 12.

Next, functions and effects of this embodiment are described.

The locks 25 are formed on the plug holder 13, and the locking pieces 25A thereof deform resiliently into the mold removing spaces 24 so that the engageable portions 22, 23 and the locking pieces 25A overlap in the width direction WD and/or the vertical direction VD when the rubber plug 12 and the plug holder 13 are assembled with the housing 10. Thus, the watertight connector can be made smaller with respect to both the width direction WD and the vertical direction VD, as compared to the prior art where the locks are positioned to avoid the mold removing spaces.

The plug holder 13 and the rubber plug 12 can be positioned with each other and the rubber plug 12 and the housing 10 can be positioned with each other by letting the locks 25 penetrate the rubber plug 12 in the thickness or forward and backward directions FBD.

The sealing edge 39 at the outer periphery of the rubber plug 12 closely contacts the inner peripheral wall of the cap 15 to provide sealing between the housing 10 and the cap 15 and between the busbar element 14 and the housing 10.

Figure 17:
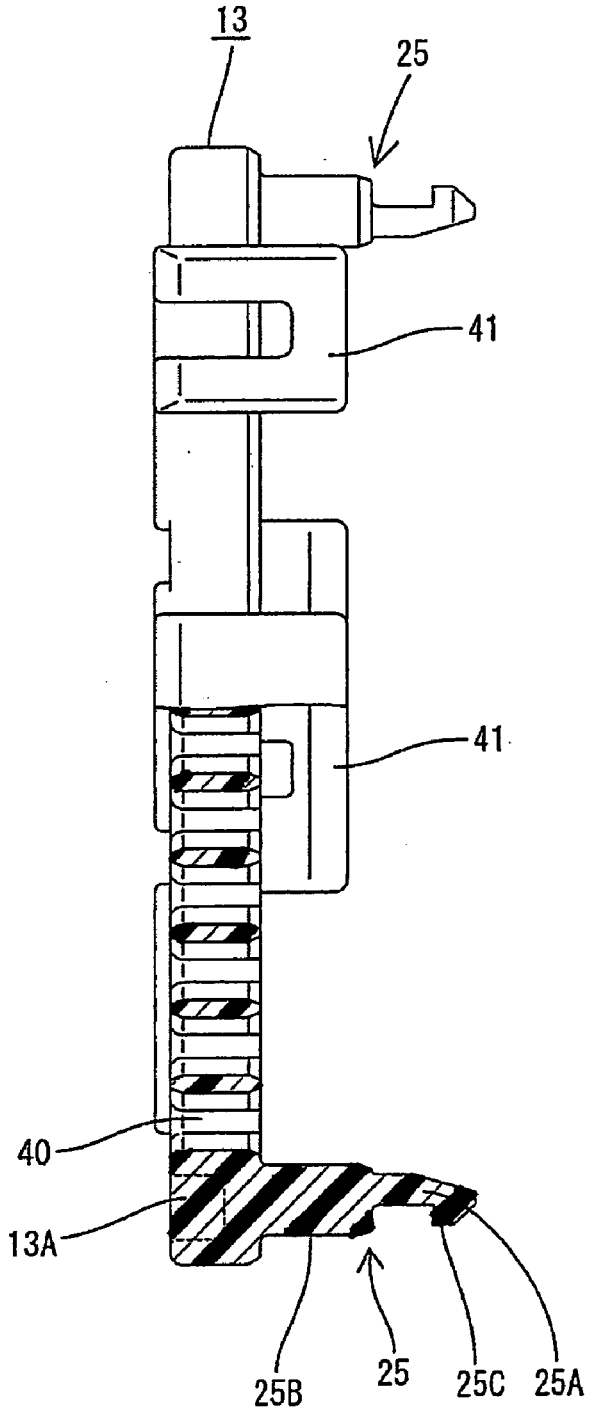
FIG. 17 is a plan view partly in section of a rubber-plug holder in a watertight connector according to a second embodiment.

A second embodiment of the invention is described with reference to FIGS. 17 to 19. The second embodiment differs from the first embodiment substantially in the constructions of base portions 25B of the locks 25 on the rubber-plug holder 13 and the fitting holes 38 of the rubber plug 12. The other construction is similar to or the same as the first embodiment. These similar structures, functions and effects are not described again, and merely are identified by the same reference numerals.

Figure 18:
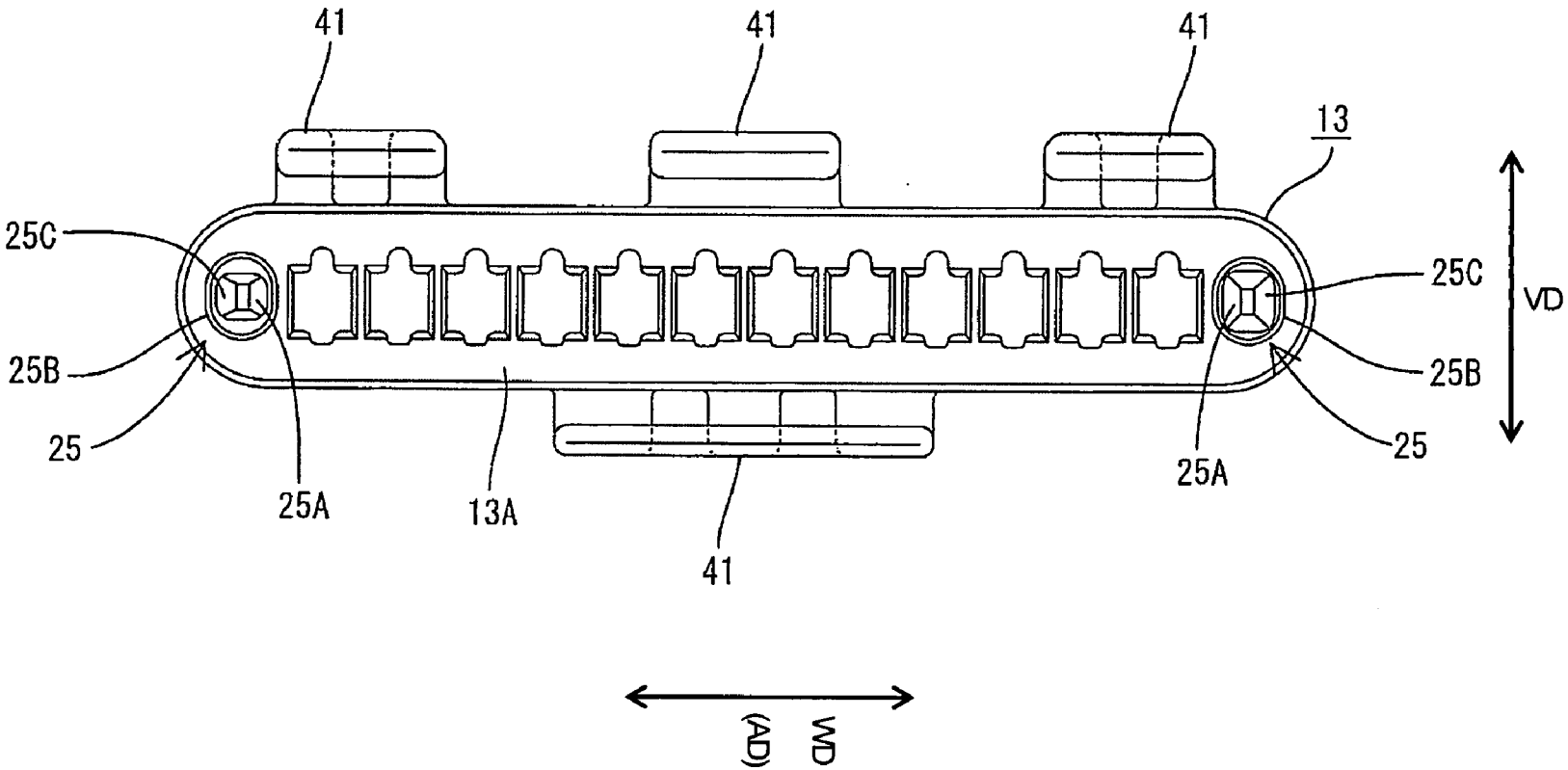
FIG. 18 is a front view of the rubber-plug holder.

As shown in FIG. 18, the base 25*b* of each lock 25 preferably has a substantially elliptical cross section with a minor axis that extends substantially along the width direction WD.

Figure 19:
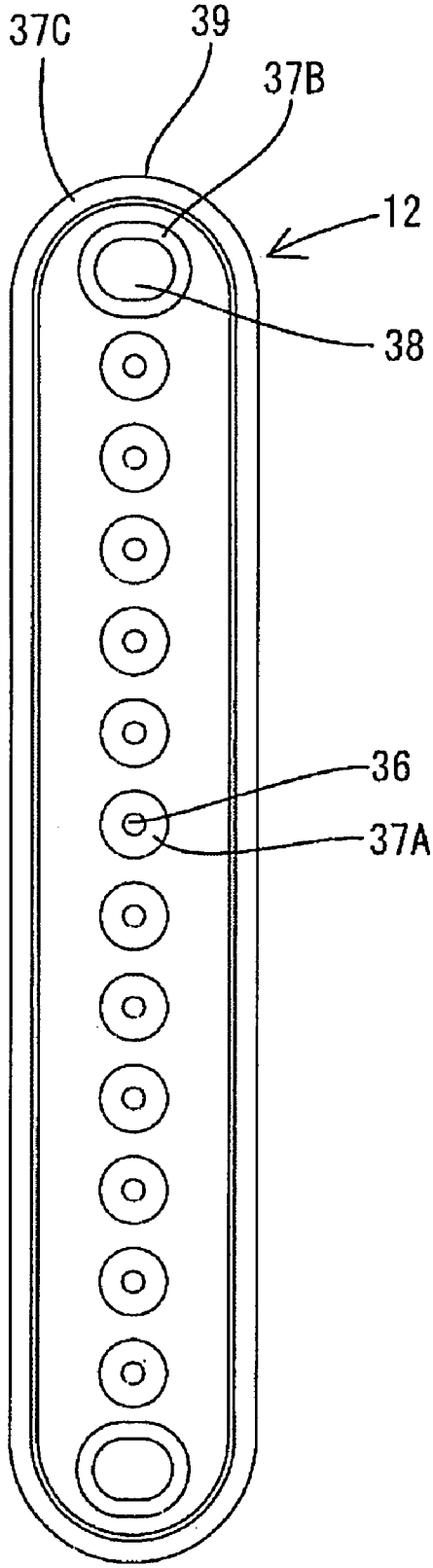
FIG. 19 is a rear view of a one-piece rubber plug.
Figure 20:
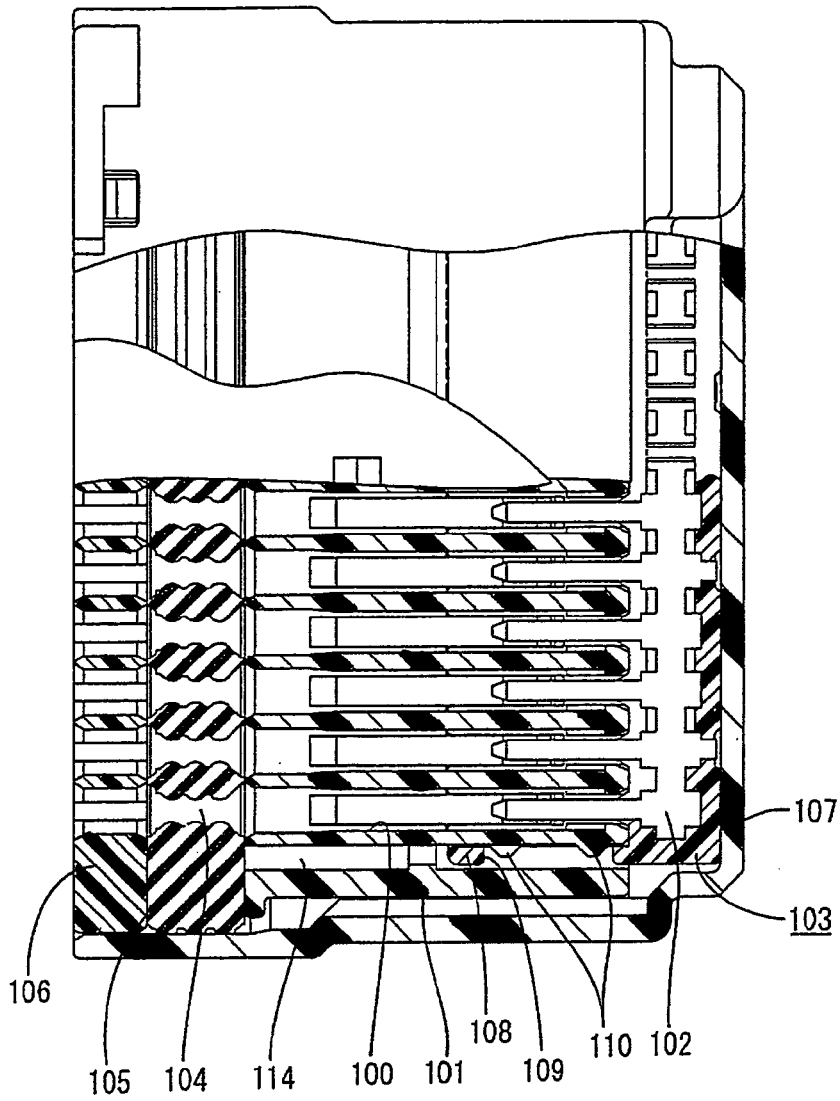
FIG. 20 PRIOR ART
FIG. 20 is a plan view partly in section of a prior art connector.
Figure 21:
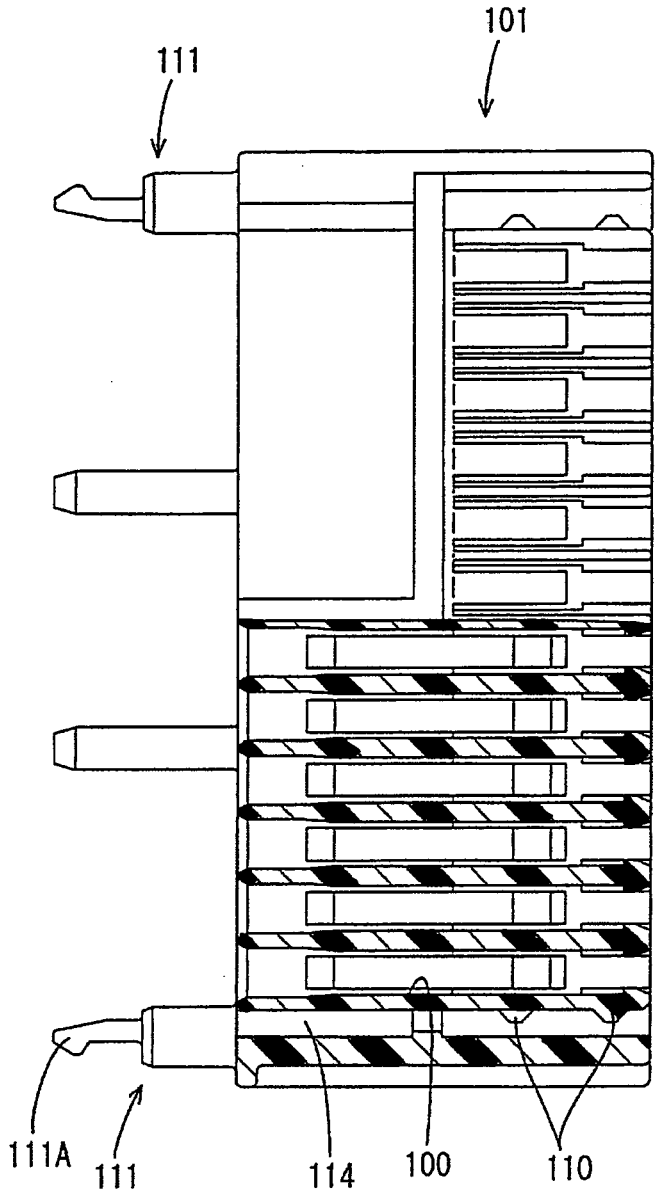
FIG. 21 PRIOR ART
FIG. 21 is a plan view in section of a housing of the connector of FIG. 20.
Figure 22:
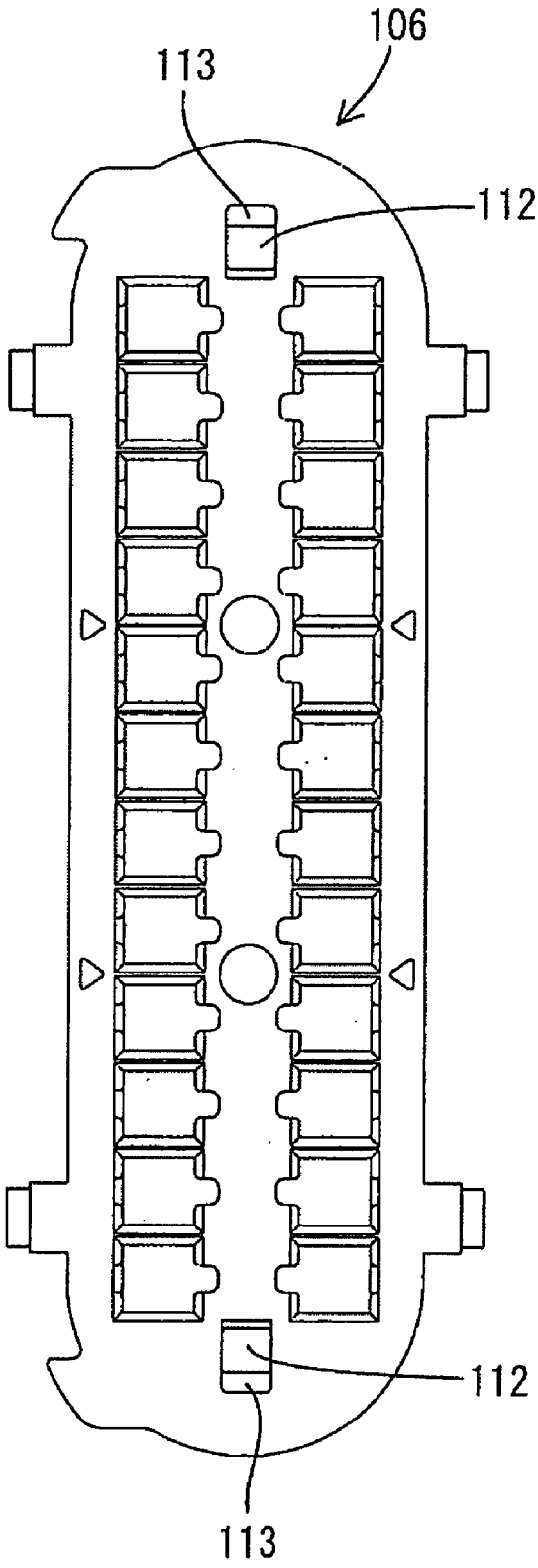
FIG. 22 PRIOR ART
FIG. 22 is a rear view of a sealing-member holder of the connector of FIG. 20.

As shown in FIG. 19, the fitting holes 38 of the rubber plug 12 also has a substantially elliptical cross section with a minor axis that extends substantially along the width direction WD, similar to the cross section of the base portions 25B. Inner surfaces of the fitting holes 38 are slightly smaller than the outer surfaces of the locks 25 to provide sealing between the fitting holes 38 and the locks 25. The orientations of these elliptical cross sections of the second embodiment enable the watertight connector to be made smaller in the width direction.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The mounting member is the busbar element 14 in the illustrated embodiments. However, the mounting member may be a front retainer for retaining the terminal fittings in the housing 10. The mounting member also could be a male housing with male terminal fittings. Further, male terminal fittings may be accommodated in the housing 10 and a female housing with female terminal fittings may be the mounting member.

The bulges 10B bulge outward along the width direction WD from the opposite left and right surfaces of the main portion 10A in the foregoing embodiments. However, the bulge 10B may bulge out along the vertical direction VD from the upper and/or lower surface of the main portion 10A.

Locks 25 penetrate the rubber plug 12 in the foregoing embodiments. However, the rubber plug 12 may be positioned in a forwardly open tubular portion of the plug holder 13. The housing 10 and the rubber plug 12 may be positioned by assembling this plug holder 13 with the housing 10. A seal ring may be mounted on the housing 10 to provide sealing between the plug holder 13 and the housing 10.

The engageable portions 22, 23 and the locks 25 overlap in both the width direction WD and the vertical direction VD in the foregoing embodiments. However, the engageable portions 22, 23 and the locks 25 may overlap only in the vertical direction VD to shorten the height of the watertight connector. Alternatively, the engageable portions 22, 23 and the locks 25 may overlap only in the width direction WD to narrow the watertight connector.

Cavities 17 are formed substantially side by side in one row in the foregoing embodiments. However, cavities 17 may be formed in a plurality of rows along the vertical direction VD.

The fitting holes 38 of the rubber plug 12 have a substantially elliptic cross section with a minor axis that extends substantially along the width direction WD, similar to the cross section of the base portions 25B of the locks 25. However, the fitting holes 38 may have a substantially round or different cross section. It is sufficient for the inner circumferential surfaces of the fitting holes 38 to be deformed to have a substantially elliptic cross section when the base portions 25B of the locks 25 are fitted into the fitting holes 38.

The elliptic cross section of the base portions 25B of the locks 25 may have a minor axis that extends substantially along the vertical direction VD.

What is claimed is:

1. A watertight connector, comprising:

a housing (10) with cavities (17) for accommodating terminal fittings (11), a mounting member (14) mountable to housing (10), a resilient plug (12) arranged with the housing (10) and formed sealing holes (36) through which the respective terminal fittings (11) are inserted to seal wires (29) connected with the respective terminal fittings (11), and a plug holder (13) arranged on the resilient plug (12) and engageable with the housing (11) to hold the resilient plug (12) between the plug holder (13) and the housing (11), wherein:

the housing (11) includes a main portion (10A) and at least one bulge (10B) bulging out in at least one of a width direction (WD) and a height direction (VD) from a side surface of the main portion (10A), the bulge (10B) includes at least one engageable portion (22; 23) for holding the mounting member (14) by engaging a latch (21) of the mounting member (14), a mold removing space (24) formed by removing a mold for forming the engageable portion (22; 23) and extending from one end of the engageable portion (22; 23) to one end surface of the bulge (10B), and a receiving portion (27) configured to hold the plug holder (13) by engaging a lock (25) on the plug holder (13), and the lock (25) being insertable into the mold removing space (24) to overlap the engageable portion (22; 23) in at least one of the width direction (WD) and the height direction (VD).

2. The watertight connector of claim 1, wherein the mounting member (14) is mountable on a front end of the housing (10).

3. The watertight connector of claim 1, wherein the resilient plug (12) is arranged at a rear end of the housing (10).

4. The watertight connector of claim 1, wherein the receiving portion (27) is disposed out from the mold removing space (24) in at least one of the width direction (WD) and the height direction (VD).

5. The watertight connector of claim 4, wherein the lock (25) penetrates the resilient plug (12) substantially in a thickness direction.

6. The watertight connector of claim 5, wherein a part of the lock (25) penetrating the resilient plug (12) substantially in the thickness direction has a substantially elliptic cross section whose minor axis extends substantially along the width direction (WD) or the height direction (VD).

7. The watertight connector of claim 1, wherein a busbar (16) is provided in the mounting member (14) and fits into the respective cavities (17) for shorting the terminal fittings (11).

8. The watertight connector of claim 1, wherein a cap (15) is mounted on the housing (10) for at least partly covering the mounting member (14) and the housing (10) from a fitting side of the mounting member (14).

9. The watertight connector of claim 8, wherein a sealing edge is formed on the resilient plug (12) for closely contacting an inner peripheral surface of the cap (15) to provide sealing between the housing (10) and the cap (25).

10. The watertight connector of claim 1, wherein the engageable portion (22; 23) and the lock (25) overlap in both the width and height directions (WD, VD).

11. A watertight connector, comprising:

a housing (10) with opposite front and rear ends and a side surface extending along a forward and backward direction (FBD) substantially between the front and rear ends, terminal cavities (17) extending through the housing (10) from the front end to the rear end, at least one engageable portion (22; 23) bulging out on the side surface of the housing (10) and at least one receiving portion (27) spaced out from the side surface of the housing (10) at a location rearward of the engageable portion (22; 23) so that a space (24) is defined between the side surface and the receiving portion (27) and between the engageable portion (22; 23) and the rear end of the housing (10);

a mounting member (14) mountable to the front end of the housing (10) and having a latch (21) engageable with the engageable portion (22; 23) for holding the mounting member (14) on the housing (10);

a resilient plug (12) mounted substantially at the rear end of the housing (10) and formed with sealing holes (36) substantially aligned with the respective terminal cavities (17); and a plug holder (13) mounted on the rear end of the housing (11), the plug holder (13) having a lock (25) at least partly in the space (24) and engaging the receiving portion (27) to hold the plug holder (13) and the resilient plug (12) on the housing (11), whereby the lock (25) is aligned at least partly with the engageable portion (22; 23) along the forward and backward direction (FBD).

12. The watertight connector of claim 11, wherein the lock (25) penetrates the resilient plug (12) substantially in the forward and backward direction (FBD).

13. The watertight connector of claim 12, wherein a part of the lock (25) penetrating the resilient plug (12) has a substantially elliptic cross section with a minor axis extending substantially along a direction (WD) normal to the side surface of the housing (10).

14. The watertight connector of claim 11, wherein a busbar (16) is provided in the mounting member (14) and fits into the respective cavities (17).

15. The watertight connector of claim 11, further comprising a cap (15) mounted on the housing (10) for at least partly covering the mounting member (14) and the housing (10).

16. The watertight connector of claim 15, wherein a sealing edge is formed on the resilient plug (12) for closely contacting an inner peripheral surface of the cap (15) to provide sealing between the housing (10) and the cap (25).

* * * * *